US005783780A

United States Patent [19]

Watanabe et al.

[11] Patent Number: 5,783,780

[45] Date of Patent: Jul. 21, 1998

[54] SOUND ABSORPTION STRUCTURE

[75] Inventors: Kyoichi Watanabe, Yokosuka; Kouichi Nemoto, Zushi, both of Japan

[73] Assignee: Nissan Motor Co., Ltd, Kanagawa, Japan

[21] Appl. No.: 753,606

[22] Filed: Nov. 27, 1996

[30] Foreign Application Priority Data

Nov. 27, 1995 [JP] Japan ..... 7-307917

[51] Int. Cl.[6] ..... F02M 35/00

[52] U.S. Cl. ..... 181/229; 181/249; 181/250; 181/252; 181/257; 181/273

[58] Field of Search ..... 181/224, 233, 181/249, 250, 251, 252, 257, 266, 267, 273, 282, 229

[56] References Cited

U.S. PATENT DOCUMENTS

| | | | |
|---|---|---|---|
| 4,211,303 | 7/1980 | Matthews et al. | 181/252 |
| 4,523,662 | 6/1985 | Tanaka et al. | 181/252 X |
| 4,841,728 | 6/1989 | Jean et al. | 181/251 X |
| 4,892,168 | 1/1990 | Sasaki et al. | 181/250 |

FOREIGN PATENT DOCUMENTS

| | | |
|---|---|---|
| 53-148617 | 12/1978 | Japan . |
| 55-167562 | 12/1980 | Japan . |
| 62-110722 | 5/1987 | Japan . |
| 64-53055 | 3/1989 | Japan . |
| 5-18329 | 1/1993 | Japan . |
| 5-18330 | 1/1993 | Japan . |

*Primary Examiner*—Khanh Dang
*Attorney, Agent, or Firm*—Foley & Lardner

[57] ABSTRACT

A sound absorption structure which is mainly applied to an intake system of an automotive engine for suppressing noise level. The sound absorption structure comprises a base duct portion, and an extended duct portion in which a sound absorption material is installed, and a Helmholtz resonator. The extended duct portion is formed such that a representative diameter of the extended duct portion is greater than that of the base duct portion while connected to the base duct portion. The Helmholtz resonator is set to be resonant at a frequency corresponding to a frequency range of a resonance generated by the installation of the extended duct portion including the sound absorption material. The Helmholtz resonator is integrally formed with the extended duct portion. Therefore, the sound absorption structure ensures an excellent sound absorption ability in the whole frequency range.

12 Claims, 7 Drawing Sheets

SOUND ABSORPTION STRUCTURE

BACKGROUND OF THE INVENTION

The present invention relates to improvements in a sound absorption structure which performs an excellent sound absorbing function in the whole frequency range.

Various methods and structures have been proposed and in practical use in order to reduce noises due to fluid movement in intake and exhaust systems, such as an intake system of an internal combustion engine. For example, Japanese Patent Provisional Publication No. 53-148617 discloses a sound absorbing unit for reducing noises generated in an intake system of an internal combustion engine. This sound absorbing unit is arranged such that a sound absorption material is installed on an intake pipe which has a plurality of openings and is disposed between a carburetor and an air cleaner in an engine intake system. Japanese Patent Provisional Publication No. 62-110722 discloses an air cleaner in which a resonator for absorbing a particular frequency is disposed at a center portion of an air-element chamber.

However, these sound absorbing devices are required to be further improved in sound absorption function while keeping a small-size thereof.

SUMMARY OF THE INVENTION

It is an object of the present invention to provide an improved sound absorption structure which performs an excellent sound absorbing function in the whole range of frequencies when installed to an air intake system, such as an engine intake system.

A sound absorption structure according to the invention comprises a base duct portion, an extended duct portion, a sound absorption material and a Helmholtz resonator. The extended duct portion is formed such that a representative diameter of the extended duct portion is greater than that of the base duct. The extended duct portion is connected to the base duct portion. The sound absorption material is installed inside of the extended duct portion. The Helmholtz resonator is resonant at a frequency corresponding to a frequency range of a resonance generated by installing the extended duct portion with the sound absorption material. The Helmholtz resonator is integrally formed with the extended duct portion.

DETAILED DESCRIPTION OF THE INVENTION

Noises generated by air flowing through ducts are mainly constituted by resonance sound within a low frequency range smaller than 500 Hz and air-flow sound having relatively high frequency. Conventionally, it has been difficult to achieve the sound absorption of the noises having wide range frequencies by means of one absorption-sound structure.

Figure 1:
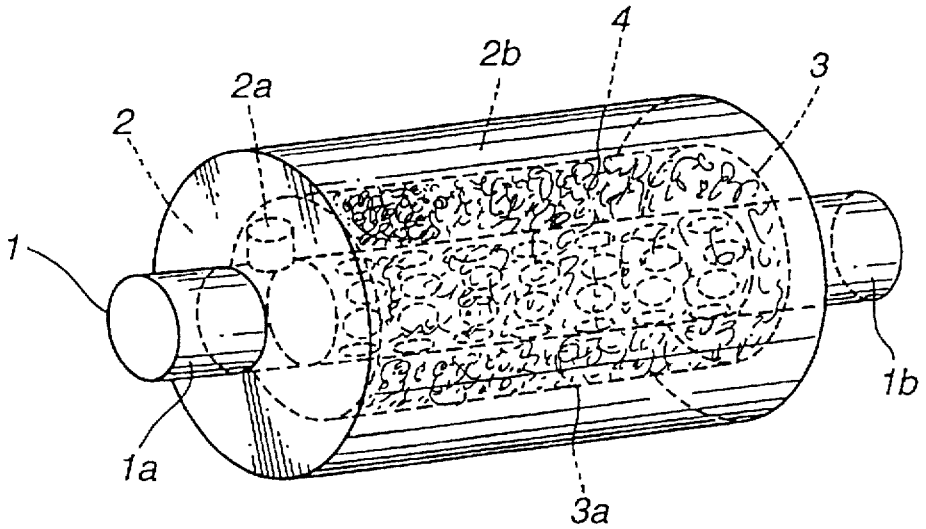
FIG. 1 is a perspective view of a sound absorption duct structure according to the present invention.

In order to reduce such noises, an improved sound-absorption structure according to the present invention is achieved by the combination of an extended duct portion 3 extended in inner diameter with respect to a base duct portion 1, a sound absorption material 4 and a Helmholtz resonator 2 as shown in FIG. 1.

The extended duct portion 3 functions as a cavity type silencer so as to damp the relatively low frequencies. The sound absorption material 4 is formed into a sound absorbing member of a porous material type and performs the sound absorption of noises including the medium and high frequencies. The Helmholtz resonator 2 is designed to be resonant at a particular frequency whose sound level has been increased by the installation of the cavity type silencer, so that the increased sound level of the newly resonated frequency due to the cavity type silencer is reduced to a level as generally the same as that of the condition that the arranged structure is not installed. This enables the total sound level to be reduced in the whole range of frequencies.

It is necessary that the sound absorption structure has the base duct portion 1 which has a basically circular, square or elliptic in cross section, and an extended duct portion 3 whose inner diameter is extended as compared with that of the base duct portion 1. The cross-section shape of the extended duct portion 3 may be formed freely. Although it is effective that the extended duct portion 3 is formed to have a cross-section similar to that of the base duct portion 1, such as an elliptic extended duct portion 3 for a circular or elliptic base duct portion 1, it is not restricted thereby.

A center axis of cross-section of the base duct portion 1 may be corresponded with that of the extended duct portion 3 or may not. Therefore, the outer periphery of the base duct portion 1 may be in contact with the outer periphery of the extended duct portion 3.

The base duct portion 1 extending from an inlet port 1*a* to an outlet part 1*b* of the sound absorption structure may be formed such that a cross-sectional center axis of the outlet part 1*b* of the base duct portion 1 is shifted from that of the inlet part 1*a* of the base duct portion 1. Further, the cross-sectional center axes of the inlet and outlet parts 1*a* and 1*b* of the base duct portion 1 and the cross-sectional center axis of the sound-absorption extended duct portion 3 may be corresponded with each other or may not. Various combinations thereof are respectively effective. The relationship between the cross-sectional center axis of the extended duct portion 3 and the cross-sectional center axis of the base duct portion 1 is depended on a space for installing the sound absorption structure. However, such limitation does not affect the sound absorbing performance as to the frequencies smaller than 500 Hz. On the other hand, with respect to the high frequency range greater than 1 kHz, the relationship between the base duct portion 1 and the extended duct portion 3 affects the sound absorption performance thereof. If the cross-sectional center axes of the respective inlet and outlet of the base duct portion 1 and the extended duct portion 3 are equivalently dispersed, a preferable sound absorbing performance is obtained. In particular, the larger separation between the cross-sectional axes of the inlet and outlet parts of the base duct portion 1 improves the sound absorbing performance. These limitation as to the arrangement of the base duct portion and the extended duct portion is largely affected by the space for installing the sound absorption structure. If such sound absorption structure is installed to an automotive vehicle and more particularly to an engine compartment of the vehicle, a front tire housing and a battery unit limits the shape and arrangement of this sound absorption structure.

By appropriately modeling sound-silence factors as to the cavity type silencer, the transmission loss TL of the silencer can be theoretically calculated. The theoretical equation is given by the follows equation (1), $$TL=10\log\,[1+\{\tfrac{1}{2}(m-1/m)\sin^2 kL\}^2] \quad (1)$$

where m is an extension ratio between an inner diameter of the base duct portion 1 and the inner diameter of the extended duct portion 3, k is a wave constant which is defined by $k=2\pi f/C$ (f: frequency and c: sound speed), and L is a length of the extended duct portion 3.

Therefore, the damped amount by the sound-absorption extended duct portion 3 is increased by setting the extension ratio at a large value, and the damping effect in the whole frequency range, particularly in a low frequency range is remarkably ensured. However, the sound absorption structure according to the present invention is arranged to install a sound absorption material 4 on an inside surface of the cavity type silencer (extended duct portion). Since it is impossible to represent the effect of the sound absorption material 4 into a theoretical equation, the sound absorption structure according to the present invention can not be explained only by the equation (1).

It is preferred that the inner diameter of the extended duct portion 3 is 1.1 to 3 times the inner diameter of the base duct portion 1. If such extension ratio is smaller than 1.1, the damping effect is almost not obtained. If the extension ratio is larger than 3.0, the volume of the sound absorption structure becomes too large to be practically installed. In particular, if such sound absorption structure is installed in the engine compartment, it is preferable to form it small as possible although the larger extension ratio improves the sound damping performance.

It is preferred that the length of the extended duct portion 3 is set within a range 1 to 100 cm. If the length of the extended duct portion becomes smaller than 1 cm, the satisfied sound damping performance can not be obtained even if the extension ratio is significantly increased. On the other hand, if the length becomes larger than 100 cm, the volume of the sound absorption structure becomes too large to be installed practically. In particular, if such sound absorption structure is applied in the engine compartment, it is preferable to form it small as possible although the larger extension ratio improves the sound damping performance. That is, the damping performance as to the low frequency range is improved by increasing the length of the extended duct portion, and the high frequency range is also improved.

According to the present invention, it is necessary to install the sound absorption material to at least one position in the extended duct portion 3. Although the sound absorption material 4 is normally installed inside of the extended duct portion 3, so as to be located between the extended diameter of the extended duct portion 3 and the diameter of the base duct portion 1, the sound absorption material 4 may be installed inside of the extended duct portion 3 without the extension of the extended duct portion 3. By extending the diameter of the extended duct portion 3, advantages for forming the cavity type silencer and for improving the sound absorbing performance are ensured. Of course, the diameter of the extended duct portion 3 may be increased by a dimension larger than the thickness of the sound absorption material 4.

It is preferred that an average fiber diameter of the sound absorption material 4 installed in the extended duct portion 3 is set within a range 0.1 to 60 μm. The performance of the sound absorption material 4 largely depends on the average fiber diameter of a fibrous aggregate of the sound absorption material 4. That is, the sound absorption performance is improved by decreasing the fiber diameter of the sound absorption material 4. However, thin fiber performs poor in rigidity and is not generally used. Therefore, it is difficult that the sound absorption material 4 made of thin fibers is installed in the extended duct portion so as to flow air therethrough. If such thin fiber performing low rigidity is used as the sound absorption material 4, it is difficult to ensure a predetermined bulkiness thereby and a predetermined binding force therebetween. Such thin fiber material tends to be separated when it is put in air flow. Therefore, it is preferred that the average fiber diameter of the sound absorption material is greater than 0.1 μm. On the other hand, the sound absorbing performance by the fiber aggregate is degraded by increasing the fiber diameter thereof. For example, if the average fiber diameter becomes greater than 60 μm, such thick fibrous aggregate can not ensure a predetermined sound absorbing performance.

The average fiber length of the sound absorption material 4 is not limited, for example, may be smaller than 5 cm or may be longer than 5 cm. Since the sound absorbing performance by the sound absorption material 4 does not depend on the fiber length thereof, it is not necessary to regulate the fiber length of the sound absorption material. However, from a viewpoint of a manufacturing process and a rigidity of the sound absorption material 4, it is necessary to limit a range of the average fiber length since the mechanical strength such as tensile strength and tear strength of the sound absorption material depends on the fiber length. Although it is preferred that the fiber length is ranging from 3 to 10 cm, it is not necessary to particularly limit it within such a limited range. However, it is difficult to form the fibers having lengths smaller than 3 cm into a sound absorbing fibrous aggregate. On the other hand, it is difficult to form the fibers having lengths larger than 10 cm into equivalently dispersed material. That is, such long fibrous aggregate tends to be formed into a partially localized material, and therefore it becomes difficult to always ensure a constant performance thereby.

Since the sound absorbing performance of the sound absorption material 4 does not depends on the combined condition of the fibrous aggregate, the fibrous aggregate of the sound absorption material 4 may be a woven fabric or nonwoven fabric. However, since the bulkiness and rigidity of the fibrous aggregate depends on the combined condition thereof, it is necessary to determine the combined condition of the sound absorption material 4 upon taking account of the circumstances around the installed position. When it is important that the fibrous aggregate performs a predetermined bulkiness, it is preferable to form the aggregate into a nonwoven fabric. On the other hand, when it is important that the fibrous aggregate performs a predetermined mechanical strength, it is preferable to form the aggregate into a woven fabric.

Although the fibers constituting the fibrous aggregate may be natural fibers or synthetic fibers, it is preferred that the fibrous aggregate is made by synthetic fibers which are constantly manufactured into a desired specific material which has desired length and thickness, and a desired distribution.

According to the present invention, the synthetic fibers constituting the fibrous aggregate may be selected from the well-known synthetic fibers, such as fibers made of nylon, poly-acrylonitrile, poly-acetate, poly-ethylene, poly-propylene, liner poly-ester, poly-amide, and the like. It is preferred that poly-ester fiber and poly-propylene fiber which can be blended with fibers having different softening points, are used in view of recycle, forming ability, and shape maintaining ability. Further, it is preferable to use polyester fiber which is manufactured by the melt spinning method and has the average diameter ranging from 10 to 40 μm. That is, it is difficult to manufacture the poly-ester fiber having the average diameter smaller than 10 μm by the melt spinning method. Further, it is difficult to ensure the predetermined sound absorbing performance by using fibers whose average diameter is greater than 40 μm since the sound absorbing performance largely depends on a surface area of the sound absorption material 4. Since the poly-ester fiber made by the melt spinning method is popular and economic, it is preferred to use it practically.

Since an ultra thin fiber of poly-propylene fiber is manufactured by the melt blown method, it is possible to improve the sound absorbing performance by using the ultra thin fiber including material. It is preferred that the average diameter of the poly-propylene fiber is ranging from 1 to 15 μm. That is, it is difficult to manufacture the poly-propylene fiber having the average diameter smaller than 1.0 μm by the melt blown method. Further, it is difficult to ensure economical merit by using the poly-propylene fiber whose average diameter is larger than 15 μm.

Although the poly-propylene fiber made by the melt blown method effectively performs to ensure a preferable sound absorbing performance, if the average diameter of the used fiber is larger than 15 μm, it is preferable to use the poly-ester fiber made by the melt spinning method, in view of the performance and economical merit.

Since the ultra thin fiber can not ensure a predetermined rigidity as a sound absorption material, a sound absorption material performing a high sound absorbing performance and a predetermined rigidity may be obtained by mixing two kinds of the poly-propylene fiber and the poly-ester fiber. Such mixed material effectively performs the sound absorbing performance when it is used in a condition of strong air-flowing.

In case that the synthetic fiber is formed into a sound absorption material, it is preferable to use a heat-fusible fibers whose softening points are different by at least 20° C. since these heat-fusible fibers enables a product to be formed by press form with a predetermined heat while keeping its shape as a fibrous aggregate. On the other hand, if the difference becomes smaller than 20° C., it becomes difficult to apply the melting fiber as a binder to the fibrous aggregate. That is, the whole fibrous aggregate may be softened and melted.

It is preferable to use a fibrous aggregate formed by the needle punch method or the like. By using this method, it becomes possible to form a fibrous aggregate made of one kind of fiber and to form the sound absorption material 4 without using the relatively expensive heat-fusible fibers.

It is preferable that the density ($g/m^2$) of such formed sound absorption material 4 ranges from 50 to 4000 $g/m^2$. If the density of the sound absorption material becomes smaller than 50 $g/m^2$, it is difficult to ensure a predetermined performance as a sound absorption structure. In reverse, if the density of the sound absorption material 4 becomes higher than 4000 $g/m^2$, the weight thereof is largely increased with the cost thereof, but the performance thereof is not effectively increased. Further, the high density material degrades its ventilating performance.

According to the present invention, it is preferable to install a cylindrical inner pipe 3*a*, which has a diameter as same as the diameter of the base duct portion 1 and has openings to ensure an opening ratio ranging from 30 to 90%, at an inside of the extended duct portion 3, in order to prevent the sound absorption material moved by the air flow flowing through the sound absorption structure. The inner pipe 3*a* is connected with the inlet and outlet of the base duct portion 1. The sound absorption material 4 is filled in a space defined by the inner pine 3*a* and the expanded duct portion 3. It is preferred that the opening ratio of the inner pipe 3*a* is set as great as possible, since the sound absorbing performance depends on the opening ratio of the inner pipe 3*a*. The opening ratio should be limited so that the inner pipe 3*a* sufficiently supports the sound absorption material. That is, if the opening ratio becomes smaller than 30%, the damping amount of the noises is largely decreased. Further, if the opening ratio becomes larger than 90%, it becomes difficult to sufficiently support the sound absorption material by reason of the degrading of the mechanical strength of the inner pipe 3*a*. The shape of the openings formed on the inner pipe 3*a* may be freely determined since the shape does almost not affect the performance of the inner pipe 3*a*.

Although it is preferable to set the opening ratio within a range 50 to 80% from the review as to the performance of the sound absorption extended duct portion 3 and the installation of the sound absorption material 4, such limitation may not be applied to the sound absorption structure according to the present invention.

It is preferred that the fibrous aggregate is fully or partly covered with a skin surface made of a nonwoven fabric of synthetic fiber which is defined such that the average fiber length is within a range 1 to 100 cm, the average diameter is within a range 1 to 30 μm and the density is within a range 20 to 200 $g/m^2$, in order to prevent the fibers removed from the sound absorption material.

The fibers are formed into a woven fabric or nonwoven fabric. In case of the nonwoven fabric, it is preferable to apply the needle punching method or a method forming by thermally melting a part of fabric as a product method thereof since it effectively performs in rigidity and permeability. Although long fibers longer than 10 cm is effective in the improvement in the rigidity, such limitation is not added to the sound absorption structure according to the present invention.

Hereinabove, the sound-absorption extended duct portion 3 of the sound absorption structure has been explained. The present invention is achieved by the combination of the above-mentioned sound-absorption extended duct portion 3 including the sound absorption material 4 and the Helmholtz resonator portion 2. Hereinafter, the Helmholtz resonator portion 2 of the sound absorption structure according to the present invention will be discussed.

Figure 14:
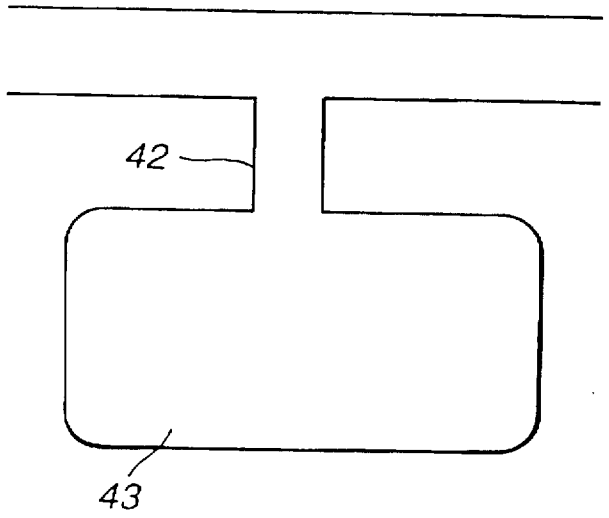
FIG. 14 is a schematic view showing a Helmholtz resonator.

A Helmholtz resonator is an acoustic device, normally shaped like a jug or bottle, which is resonant at predetermined frequencies. FIG. 14 shows a schematic view of a popular Helmholtz resonator including a neck portion and a volumetric portion. A set frequency fr to be absorbed by a Helmholtz resonator is obtained by determining a ratio between a volume of a neck portion and a volume of a volumetric portion and by using the following equation (2).

$$fr=c/2\pi\ (\text{route})(S/L/V) \tag{2}$$

where c is the speed of sound in the air, S is the cross-sectional area of the neck portion, L is the effective length of the neck portion, and V is the volume of the volumetric portion.

Since a new resonance is generated at the set frequency by the installation of the Helmholtz resonator 2, the previously existed loop of the sound pressure at the set frequency is depressed to achieve sound-suppression as to the aimed frequency. However, since a new loop of the sound pressure due to the rebound of the new resonance is generated, a frequency in the vicinity of the suppressed frequency is degraded in sound pressure. Further, if a large-volume resonator is used, a large sound-suppression is obtained with a large rebound due to this resonance.

A cavity type silencer performs as similar to a resonator. That is, if such a cavity type silencer is applied without sound absorption material, the cavity type silencer generates a rebound resonance to a frequency in the vicinity of the frequency processed by the silencer. By the provision of the sound absorption material inside of the cavity type silencer, both the previously existed resonance and the newly generated resonance were damped by the sound absorption material. Therefore, no degradation as to the sound level was not found generated so that the newly generated resonance was damped to a level before the installation of the sound absorption duct.

However, since almost no sound absorption was executed as to the frequency at the rebounded range, a combination structure of the sound absorption duct structure and the Helmholtz resonator structure is provided so as to damp the sound pressure at the rebound frequency and to achieve the sound absorption in the whole frequency range.

In the installation of the Helmholtz resonator 2 to the sound absorption structure, it is important to design the Helmholtz resonator 2 such that the Helmholtz resonator 2 is resonant at the frequency corresponding to the rebound frequency range by reason of the installation of the sound absorption duct structure. Since the rebound resonance may have a range of several tens Hz in relation to volume of the sound absorption structure, it is preferable to set the resonant frequency of the Helmholtz resonator 2 at the frequency where the sound pressure level due to the rebound of the silencer becomes maximum. If the resonant frequency of the Helmholtz resonator 2 is set within the rebound range, a predetermined sound absorption is executed. Therefore, the Helmholtz resonator 2 in the sound absorption structure according to the present invention is not limited to set the resonant frequency at the value generating the maximum rebound sound pressure level.

Although the Helmholtz resonator 2 for the rebound frequency of the sound absorption duct portion 3 and 4 generates a rebound to a predetermined frequency as similar to a common resonator, the rebound frequency by the Helmholtz resonator 2 has already been largely damped by the sound absorption duct, and the sound pressure level of the rebound frequency never takes a value larger than a level at non-installation condition of the sound absorption structure. Therefore, by the installation of the sound absorption structure according to the present invention, a preferable sound absorption is ensured in the whole frequencies. It is preferred that the Helmholtz resonator 2 is installed at a place where the resonance is generated at the set frequency, in order to effectively use the Helmholtz resonator. However, it is practically difficult to install the Helmholtz resonator 2 at such a resonance generating place so that the Helmholtz resonator 2 fully performs its sound absorbing function. In such case, the sound absorption structure performs a characteristic such that the rebound of the newly resonance does not become great if the newly formed resonance does not become great. By utilizing this characteristic, the installed position of the Helmholtz resonator 2 is intendedly put out of the mode position, and the sound absorption structure effectively functions in the whole frequencies range. Since the rebound resonance generated by the installation of the sound absorption structure is not so large, it is sufficient to generate a small resonance. A small sized Helmholtz resonator may be installed to the sound absorption structure in order to generate a weak resonance. Since the aimed frequency of the Helmholtz resonator 2 is determined by a ratio between the volume of the neck portion and the volume of the volumetric portion used in the equation (2), the magnitude of the volumes of the neck portion 2*a* and the volumetric portion 2*b* does not affect the setting of the aimed frequency in theory. However, the damping effect depends on the volumes of the volumetric portion 2*b*, and therefore if a large sized resonator is applied to the sound absorption structure according to the present invention the sound suppression of the set frequency is effectively executed.

In case that it is desired to execute the sound absorption of the other frequency rather than the rebound frequency, it is effective to set the resonant frequency of the Helmholtz resonator 2 at the other frequency. Further, in order to execute the sound absorption of the rebound frequency, a plurality of Helmholtz resonators whose resonant frequencies are set to at least two frequencies or at least two Helmholtz resonators whose resonant frequencies are set to one frequency, may be installed to the sound absorption structure according to the present invention. Furthermore, in order to execute the sound absorption of the frequency except for the rebound frequency, a plurality of Helmholtz resonators whose resonant frequencies are set to at least two frequencies may be installed to the sound absorption structure according to the present invention. Such installation is practically determined taking account of the volume balance of the applied Helmholtz resonators 2. However, such limitation may not be applied to the sound absorption structure according to the present invention.

It is preferable to set the cross-sectional area of the neck portion 2*a* of the Helmholtz resonator 2 within range 7 to 400 $cm^2$. Since the resonant frequency of the installed Helmholtz resonator 2 is determined on the basis of the volume of the neck portion 2*a* and the volume of the volumetric portion 2*b*, if a low frequency is set as a resonant frequency of the applied Helmholtz resonator 2, it is necessary to arrange the Helmholtz resonator 2 so as to decrease the cross-sectional area of the neck portion 2*a* and to increase the length of the neck portion 2*a*. In this case, if the cross-sectional area of the neck portion 2*a* becomes smaller than 7 $cm^2$, it becomes impossible that the Helmholtz resonator 2 using such neck portion 2*a* ensure the predetermined sound absorption although the resonant frequency of the Helmholtz resonator 2 is set at a desired low frequency. On the other hand, if the cross sectional area becomes larger that 400 $cm^2$, the volume of the Helmholtz resonator 2 extremely becomes great so that it can not be installed in an engine compartment of an automotive vehicle. If the sound absorption structure including the Helmholtz resonator 2 is applied to a small-size automotive vehicle, it is preferable to limit the cross-sectional area of the neck portion within a range 5 to 25 $cm^2$ from the viewpoint of the balance between volume and performance.

The shape of the neck portion 2*a* of the Helmholtz resonator 2 is not limited, for example, may be arranged into a single hole type formed by one hole, a slit type constituted by a plurality of holes. The types of the neck shape may be determined on the basis of the balance of the volume of the Helmholtz resonator 2, the aimed resonant frequency and a structure of the sound absorption duct 3 and 4. The sound absorption structure according to the present invention may not be limited by these shapes.

In order to obtain the resonant frequency at a low frequency while keeping the volume of the resonator and ensuring a predetermined cross-sectional area of the neck portion 2*a*, it is preferable to select a Helmholtz resonator 2 having a neck shape which is formed such that the neck portion 2*a* is inserted in the volumetric portion 2*b*. Since the disposition of this insert type neck portion 2*a* in the base duct increases the air flow loss of the base duct, it is not preferable to dispose such type neck portion 2*a* in the base duct portion 1. That is, it is preferable to dispose such insert type neck portion 2*a* in the volumetric portion 2*b* of the Helmholtz resonator 2.

Figure 5:
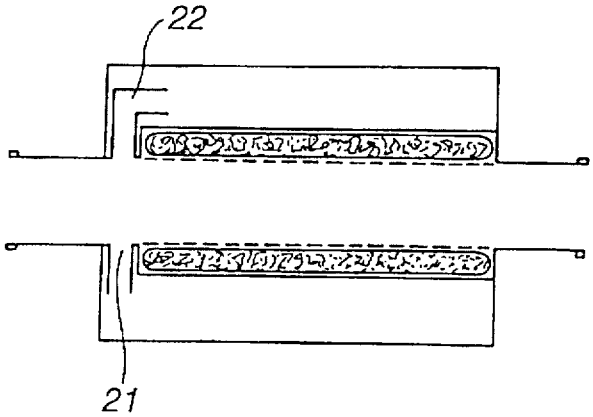
Figure 6A:
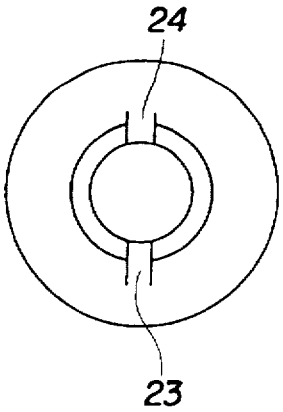
FIGS. 6 and 6A are schematic views showing a structure of the sound absorption duct of a type E.
Figure 6:
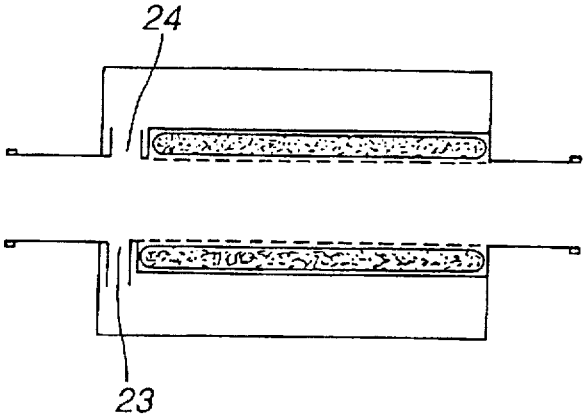
Figure 7A:
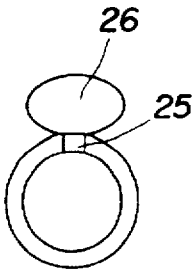
FIGS. 7 and 7A are schematic views showing a structure of the sound absorption duct of a type F.
Figure 7:
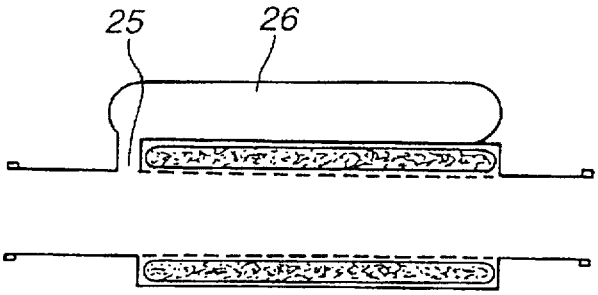
Figure 8A:
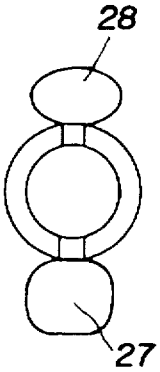
FIGS. 8 and 8A are schematic views showing a structure of the sound absorption duct of a type G.
Figure 8:
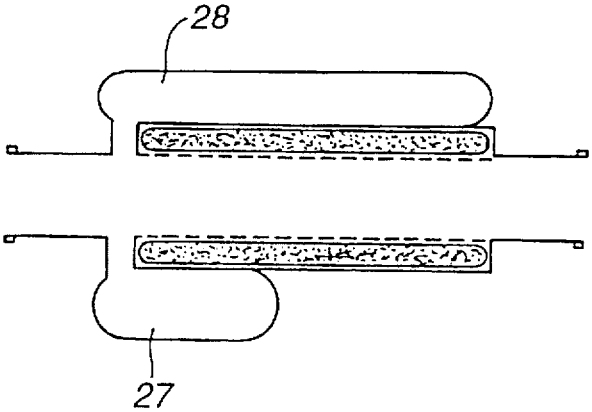
Figure 9A:
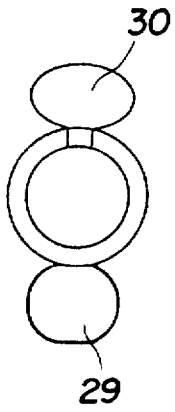
FIGS. 9 and 9A are schematic views showing a structure of the sound absorption duct of a type H.
Figure 9:
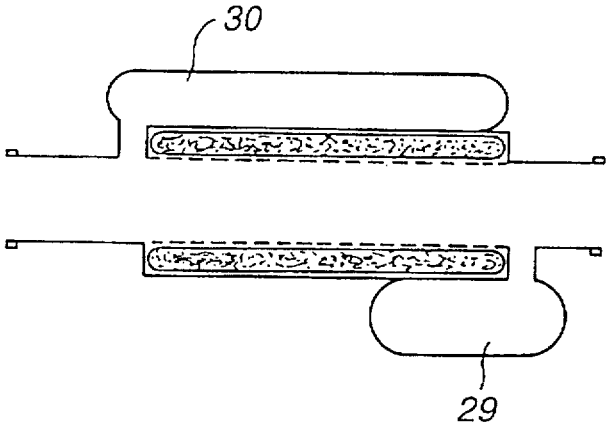

The neck portion 2*a* of the Helmholtz resonator 2 may be connected to a desired various positions of the base duct. In order to improve the damping effect of the resonance duct portion 3 and 4, it is preferable to locate the Helmholtz resonator 2 at both lateral sides of the sound absorption duct so as to locate the neck portion 2*a* in the vicinity of the sound pressure loop of the aimed frequency as possible. Further, when a plurality of Helmholtz resonators 2 are installed in the sound absorption structure, the neck portions 2*a* of the resonators 2 may be located at a center portion and both lateral sides of the sound absorption duct. It preferable to locate the volumetric portion 2*b* of the Helmholtz resonator 2 around the sound absorption duct 3 and 4 as shown in FIGS. 7 to 9 or so as to surround the sound absorption duct as shown in FIGS. 2 to 6. It is preferable to arrange the resonators upon concentrating and integrating such large volumetric portions to decrease the total volume of the sound absorption structure according to the present invention. Further, if the sound absorption structure according to the present invention is formed into an integrally formed product, such sound absorption structure further improved in production cost. It will be understood that the sound absorption duct portion and the Helmholtz resonator 2 of the sound absorption structure according to the present invention may not be integrally formed in some cases.

It is preferable to apply the sound absorption structure according to the present invention to an intake system of an automotive vehicle. The sound absorption structure executes an effective sound absorption of the noises generating by air-aspiration of the engine while maintaining the preferable air flow performance in the intake system. Furthermore, it becomes possible to remove conventional resonator or side-branch resonator by the installation of the sound absorption structure in the intake system. This largely improves in the space utility in the engine compartment and in production cost.

Finally, we researched that the sound absorption structure according to the present invention preferably performed sound absorbing ability in medium and high frequency ranges in addition to a low frequency range when it was applied to a fan duct for a house and to an intake system of an automotive vehicle.

EXAMPLE NO. 1

Figure 2A:
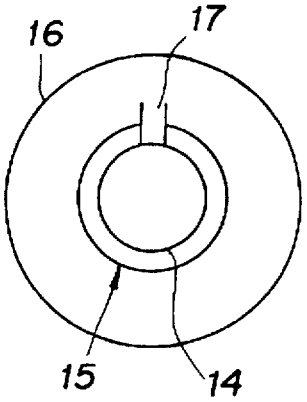
FIGS. 2 and 2A are schematic views showing a structure of a sound absorption duct of a type A.
Figure 2:
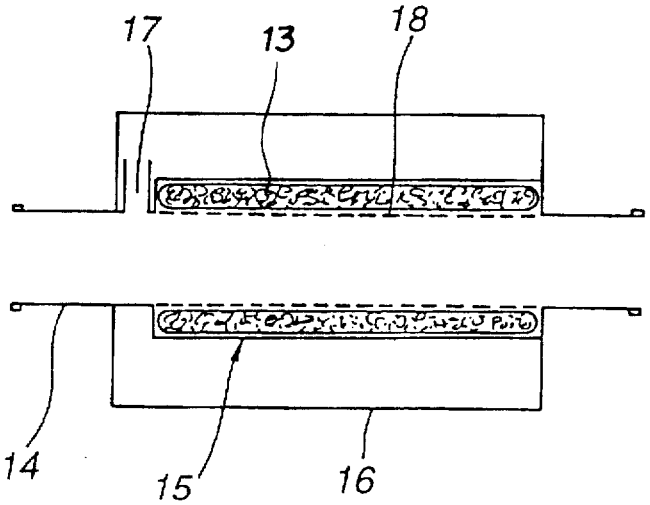

A sound absorption duct structure (Example 1) was formed into a type A of a sound absorption duct shape as shown in FIGS. 2 and 2A. A base duct portion 14 was formed circular in cross-section and had 5 cm in diameter. An extended duct portion 15 was formed such that an extension ratio of the extended duct portion 15 was 1.5 with respect to the base duct 14 and had a longitudinal length of 20 cm. A sound absorption material 13 is installed between the extended duct portion 18 and an inner pipe 15*a*. The sound absorption material 13 was made of polypropylene (PP) fiber where average fiber diameter is 3–5 μm and density is 800 $g/m^2$. A total weight of the sound absorption material was 20 g.

The inner pipe 18 overlapped with the extended duct portion 15 was formed to have an opening ratio 80%. The sound absorption material 13 was installed between the inner pipe 18 including openings and the extended duct portion 15 so as to be sandwiched therebetween.

A Helmholtz resonator 16 was installed to the extended duct portion 15 so as to be resonant at 150 Hz frequency sound and was formed to have a neck portion 17 which is of an insert type and has an opening portion having a cross-sectional area of 9 $cm^2$. The Helmholtz resonator 16 was installed to the base duct portion 14 to surround the extended duct portion 15.

EXAMPLE NO. 2

Figure 3A:
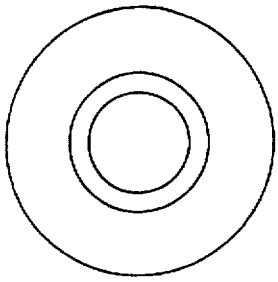
FIGS. 3 and 3A are schematic views showing a structure of the sound absorption duct of a type B.
Figure 3:
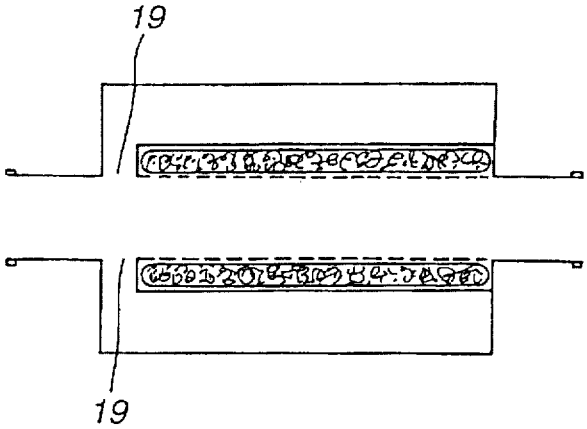

Example 2 of the sound absorption structure according to the present invention was formed to be the same as Example 1 except that a neck portion 19 of a Helmholtz resonator 16 was formed into a single hole type. The shape of the sound absorption duct was of a type B as shown in FIGS. 3 and 3A.

EXAMPLE NO. 3

Example 3 of the sound absorption structure according to the present invention was formed to be the same as Example 1 except that a neck portion of a Helmholtz resonator was formed into a slit type. The shape of the sound absorption duct was of a type B as shown in FIGS. 3 and 3A.

EXAMPLE NO. 4

Figure 4A:
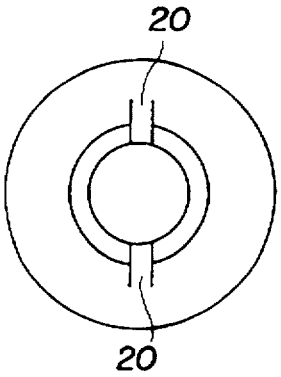
FIGS. 4 and 4A are schematic views showing a structure of the sound absorption duct of a type C.
Figure 4:
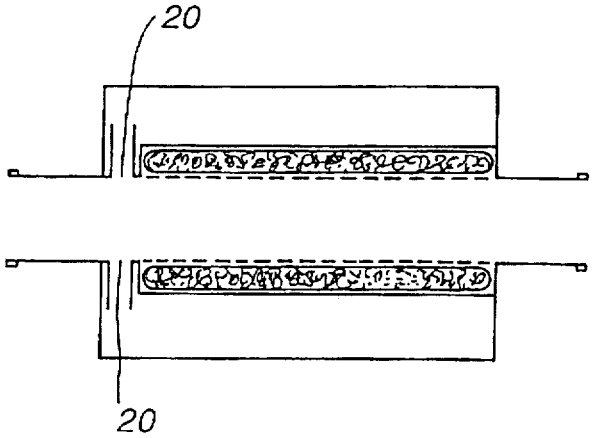

Example 4 of the sound absorption structure according to the present invention was formed such that an extended duct portion is surrounded by a Helmholtz resonator which is resonant at 150 Hz frequency and was formed to have a pair of neck portions 20 which are of an insert type and have an opening portion of 9 $cm^2$cross-section. The shape of the sound absorption duct was of a type C as shown in FIGS. 4 and 4A. The other portion of Example 4 is the same as that of Example 1.

EXAMPLE NO. 5

Figure 5A:
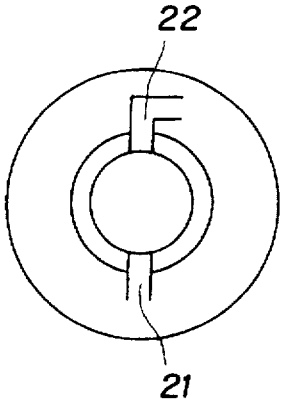
FIGS. 5 and 5A are schematic views showing a structure of the sound absorption duct of a type D.

Example 5 of the sound absorption structure according to the present invention was formed such that an extended duct portion is surrounded by a pair of Helmholtz resonators. one of the Helmholtz resonators was resonant at 150 Hz frequency and had an insert type neck portion 21 having an opening portion of 9 $cm^2$ in cross-section. The other one of the Helmholtz resonators was resonant at 130 Hz frequency and had an insert type neck portion 22 having an opening portion of 9 $cm^2$ in cross-section. The shape of the sound absorption duct was of a type D as shown in FIGS. 5 and 5A. The other portion of Example 5 is the same as that of Example 1.

EXAMPLE NO. 6

Example 6 of the sound absorption structure according to the present invention was formed such that an extended duct portion is surrounded by a pair of Helmholtz resonators. One of the Helmholtz resonators was resonant at 150 Hz frequency and had an insert type neck portion 23 having an opening portion of 9 $cm^2$ in cross-section. The other one of the Helmholtz resonators was resonant at 350 Hz frequency and had an insert type neck portion 24 having an opening portion of 9 $cm^2$in cross-section. The shape of the sound absorption duct was of a type E as shown in FIGS. 6 and 6A. The other portion of Example 6 is the same as that of Example 1.

EXAMPLE NO. 7

Example 7 was provided with a Helmholtz resonator which was disposed at a lateral side of the extended duct portion. The Helmholtz resonator was of a type F as shown in FIGS. 7 and 7A and was constituted by a volumetric portion 26 and a neck portion 25 which communicates the volumetric portion and the base portion. The other portion of Example 7 was the same as that of Example 1.

EXAMPLE NO. 8

Example 8 was provided with first and second Helmholtz resonators which were disposed at both lateral sides of the extended duct portion. The Helmholtz resonators were of a type G as shown in FIGS. 8 and 8A. Each Helmholtz resonator was constituted by a volumetric portion 27, 28 and a neck portion which communicates the volumetric portion and the base portion. The other portion of Example 8 was the same as that of Example 1.

EXAMPLE NO. 9

Example 9 was provided with first and second Helmholtz resonators which were disposed at both lateral sides of the extended duct portion. The Helmholtz resonators were of a type H as shown in FIGS. 9 and 9A. Each Helmholtz resonator was constituted by a volumetric portion 29, 30 and a neck portion which communicates the volumetric portion and the base portion. The other portion of Example 9 was the same as that of Example 1.

EXAMPLE NO. 10

Figure 10A:
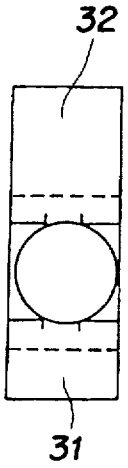
FIGS. 10, 10A and 10B are schematic views showing a structure of the sound absorption duct of a type I.
Figure 10:
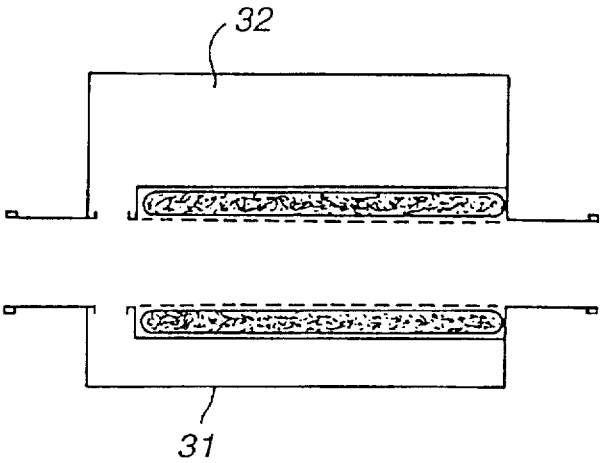
Figure 10B:
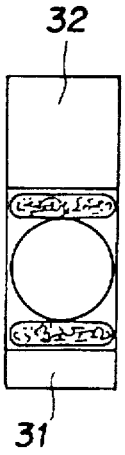

Example 10 was formed into a type I of the sound absorption duct shape as shown in FIGS. 10, 10A and 10B. A base duct portion was formed circular in cross-section and had a diameter of 5 cm. An extended duct portion was formed rectangular in cross-section. The center axis of the extended duct portion is corresponded with the center axis of the base duct. An extension ratio of the extended duct portion was 1.5 with respect to the base duct portion and had a longitudinal length of 20 cm. An inner pipe portion was formed to have a diameter as same as that of the base duct and have an opening ratio 80%. A sound absorption material was installed between the inner pipe portion and the extended duct portion so as to be sandwiched therebetween. More particularly, the sound absorption material is divided into two part and separately installed to both lateral sides of the inner pipe along the air-flow direction. The sound absorption material was made of polypropylene (PP) fiber where average fiber diameter is 3–5 μm and density is 800 $g/m^2$.

First and second Helmholtz resonators 31 and 32 were installed to both lateral sides of the extended duct portion. The first Helmholtz resonator 31 was set to be resonant at 150 Hz frequency sound and was formed to have a neck portion through which is of an insert type and has an opening portion of 9 $cm^2$ in cross-section. The neck portion of the first Helmholtz resonator 31 connected a volumetric portion of the first Helmholtz resonator 31 with the base duct portion. The second Helmholz resonator 32 was set to be resonant at 350 Hz frequency sound and was formed to have a neck portion through which is of an insert type and has an opening portion of 9 $cm^2$in cross-section. The neck portion of the second Helmholtz resonator 32 connected a volumetric portion of the second Helmholtz resonator with the base duct portion.

EXAMPLE NO. 11

Figure 11A:
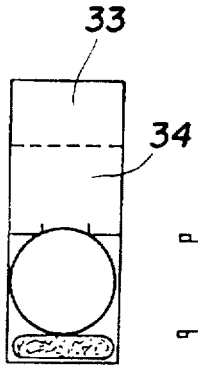
FIGS. 11, 11A and 11B are schematic views showing a structure of the sound absorption duct of a type J.
Figure 11:
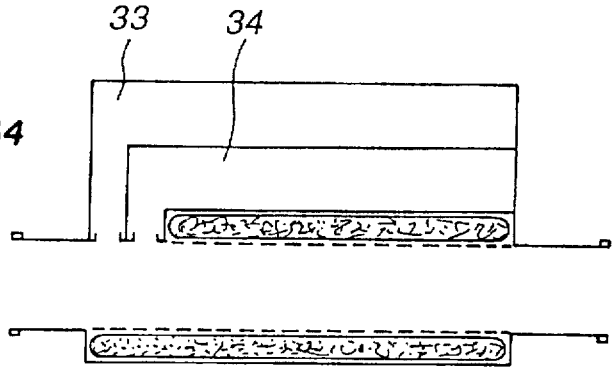
Figure 11B:
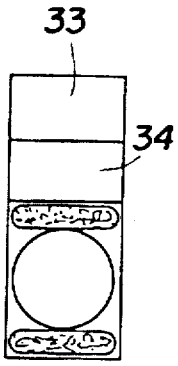

Example 11 of the sound absorption structure according to the present invention was formed to be the same as Example 10 except that the volumetric portions of the first and second Helmholtz resonators 33 and 34 were disposed at one lateral side of the extended duct as is clearly shown in FIGS. 11, 11A and 11B. The shape of the sound absorption duct was of a type J.

EXAMPLE NO. 12

Figure 12A:
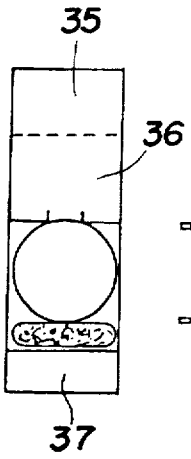
FIGS. 12, 12A and 12B are schematic views showing a structure of the sound absorption duct of a type K.
Figure 12:
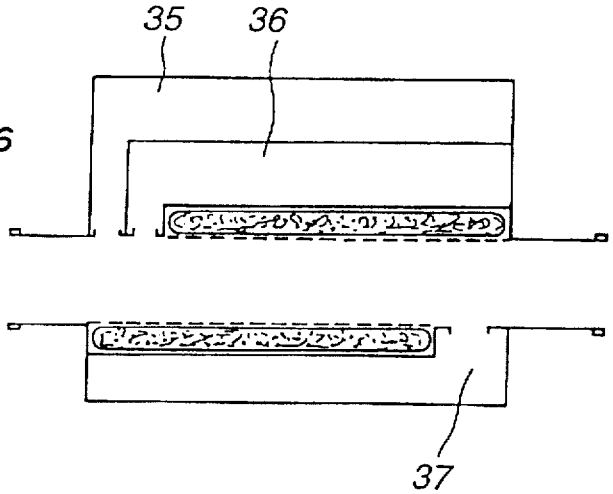
Figure 12B:
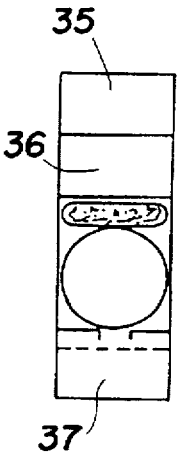

Example 12 of the sound absorption structure according to the present invention was formed to be the same as Example 10 except that a third Helmholtz resonator 37, which is resonant at 130 Hz frequency, was installed to the extended duct portion in addition to first and second Helmholtz resonators 35 and 36. The third Helmholtz resonator 37 was disposed at the other lateral side of the extended duct as is clearly shown in FIGS. 12, 12A and 12B. The shape of the sound absorption duct was of a type K.

EXAMPLE NO. 13

Example 13 of the sound absorption structure according to the present invention was formed to be the same as Example 1 except that the extension ratio of the extended duct portion was 2 and the extension ratio of the sound absorption duct shape A is 5 times.

EXAMPLE NO. 14

Example 14 of the sound absorption structure according to the present invention was formed to be the same as Example 1 except that the extension ratio of the extended duct portion was 1.5 and the extension ratio of the sound absorption duct shape A is 5 times.

EXAMPLE NO. 15

Example 15 of the sound absorption structure according to the present invention was formed to be the same as Example 1 except that the extension ratio of the extended duct portion was 1.1 and the extension ratio of the sound absorption duct shape A is 1.5.

EXAMPLE NO. 16

Example 16 of the sound absorption structure according to the present invention was formed to be the same as Example 1 except that the longitudinal length of the extended duct portion was 90 cm and the longitudinal length of the sound-absorption duct shape A was about 90 cm.

EXAMPLE NO. 17

Example 17 of the sound absorption structure according to the present invention was formed to be the same as Example 1 except that the longitudinal length of the extended duct portion was 2 cm and the longitudinal length of the sound-absorption duct shape A was about 5 cm.

EXAMPLE NO. 18

Example 18 of the sound absorption structure according to the present invention was formed to be the same as Example 1 except that the cross-sectional area of an opening portion of the neck portion of the Helmholtz resonator was 6 $cm^2$.

EXAMPLE NO. 19

Example 19 of the sound absorption structure according to the present invention was formed to be the same as Example 1 except that the cross-sectional area of an opening portion of the neck portion of the Helmholtz resonator was 290 $cm^2$.

EXAMPLE NO. 20

Example 20 of the sound absorption structure according to the present invention was formed to be the same as Example 1 except that the sound absorption material was polyester (PET) fiber where an average fiber diameter was about 20 μm and a density is 1000 $g/m^2$.

EXAMPLE NO. 21

Example 21 of the sound absorption structure according to the present invention was formed to be the same as Example 1 except that the sound absorption material was polyester (PET) fiber where an average fiber diameter was about 20 μm and a density is 2000 $g/m^2$.

EXAMPLE NO. 22

Example 22 of the sound absorption structure according to the present invention was formed to be the same as Example 1 except that the sound absorption material was polyester (PET) fiber where an average fiber diameter was about 40 μm and a density is 1000 $g/m^2$.

EXAMPLE NO. 23

Example 23 of the sound absorption structure according to the present invention was formed to be the same as Example 1 except that the sound absorption material was PP fiber where an average fiber diameter was about 3 μm, the density is 600 $g/m^2$ and the total amount of the sound absorption material was 10 g.

EXAMPLE NO. 24

Example 24 of the sound absorption structure according to the present invention was formed to be the same as Example 1 except that the sound absorption material was a mixture of PP fiber having an average fiber diameter of about 3 μm and PET fiber having an average fiber diameter of about 15 μm, and a density of the mixture was 1000 $g/m^2$ and the total amount of the sound absorption material was 20 g.

EXAMPLE NO. 25

Example 25 of the sound absorption structure according to the present invention was formed to be the same as Example 1 except that a skin surface of nonwoven fabric constituted by PET fiber having an average fiber length of about 20 cm and an average fiber diameter of about 3 μm and a density 50 $g/m^2$ was installed at an inner surface of the sound absorption material.

EXAMPLE 26

Example 26 of the sound absorption structure according to the present invention was formed to be the same as Example 1 except that the inner pipe portion having 80% opening ratio was detached from the extended duct portion.

COMPARATIVE EXAMPLE 1

Comparative Example 1 was formed to be the same as Example 1 except that the cross-sectional area of an opening portion of the neck portion of the Helmholtz resonator was 2.3 $cm^2$.

COMPARATIVE EXAMPLE 2

Comparative Example 2 was formed to be the same as Example 1 except that the cross-sectional area of an opening portion of the neck portion of the Helmholtz resonator was 450 $cm^2$. Comparative Example 2 was too big to be installed in an engine compartment of a vehicle.

COMPARATIVE EXAMPLE 3

Comparative Example 3 was formed to be the same as Example 1 except that the extension ratio of the extended duct portion was 1.05 and the extension ratio of the sound absorption duct shape A is 2.

COMPARATIVE EXAMPLE 4

Comparative Example 4 was formed to be the same as Example 1 except that the extension ratio of the extended duct portion was 3.5 and the extension ratio of the sound absorption duct shape A is 5. The extended duct portion was too big to effectively install a Helmholtz resonator resonant at a rebound frequency.

COMPARATIVE EXAMPLE 5

Comparative Example 5 was formed to be the same as Example 1 except that the extension ratio of the extended duct portion was 2 and the extension ratio of the sound absorption duct shape A is 6. Comparative Example 5 was too big to be installed in an engine compartment of a vehicle.

COMPARATIVE EXAMPLE 6

Comparative Example 6 was formed to be the same as Example 1 except that the longitudinal length of the extended duct portion was 3 cm and the longitudinal length of the sound-absorption duct shape A was about 3 cm.

COMPARATIVE EXAMPLE 7

Comparative Example 7 was formed to be the same as Example 1 except that the longitudinal length of the extended duct portion was 120 cm and the longitudinal length of the sound-absorption duct shape A was about 120 cm. Comparative Example 7 was too big to be installed in an engine compartment of a vehicle.

COMPARATIVE EXAMPLE 8

Comparative Example 8 was formed to be the same as Example 1 except that the sound absorption material was PP fiber whose average fiber diameter was smaller than 0.1 μm. Since this sound absorption material performed a small rigidity and was removed during the measurement test, Comparative Example 8 did not function as a sound absorption structure.

COMPARATIVE EXAMPLE 9

Comparative Example 9 was formed to be the same as Example 1 except that the sound absorption material was PET fiber whose average fiber diameter was larger than about 65 μm.

COMPARATIVE EXAMPLE 10

Comparative Example 10 was formed to be the same as Example 1 except that the density of sound absorption material was 30 g/m$^2$.

COMPARATIVE EXAMPLE 11

Comparative Example 11 was formed to be the same as Example 1 except that the density of sound absorption material was 5000 g/m$^2$.

COMPARATIVE EXAMPLE 12

Comparative Example 12 was formed to be the same as Example 1 except that the opening ratio of the inner pipe portion was 20%.

COMPARATIVE EXAMPLE 13

Comparative Example 13 was formed to be the same as Example 1 except that the opening ratio of the inner pipe portion was 20%. Since this sound absorption material was removed during the measurement test, Comparative Example 13 did not function as a sound absorption structure.

COMPARATIVE EXAMPLE 14

Comparative Example 14 was formed to be the same as Example 1 except that except that a skin surface of non-woven fabric constituted by PET fiber having an average fiber length of about 20 cm and an average fiber diameter of about 3 μm and a density 250 g/m$^2$ was installed at an inner surface of the sound absorption material. Comparative Example 14 performed bad in sound absorption.

COMPARATIVE EXAMPLE 15

Comparative Example 15 was formed to be the same as Example 1 except that except that a skin surface of non-woven fabric constituted by PET fiber having an average fiber length of about 20 cm and an average fiber diameter of about 3 μm and a density 10 g/m$^2$was installed at an inner surface of the sound absorption material. Since this sound absorption material was removed during the measurement test, Comparative Example 15 did not function as a sound absorption structure.

REFERENTIAL EXAMPLE 1

The sound pressure level by each frequency was measured regarding Example 1 under a condition that the sound absorption structure of Example 1 was installed to an inlet duct of an air cleaner of a vehicle and an engine of the vehicle is operated. As a result of this test. It is confirmed that Example 1 performed good in sound absorption performance as is generally the same as that in an acoustic vibration test.

REFERENTIAL EXAMPLE 2

The sound pressure level by each frequency was measured regarding Examples 1, 9 and 24 under a condition that the sound absorption structure of Example 1 was installed to an outlet side of an air cleaner of a vehicle and an engine of the vehicle is operated. As a result of this test. It is confirmed that Examples 1, 9 and 24 performed good in sound absorption performance as is generally the same as that in an acoustic vibration test, without removing of the sound absorption material.

REFERENTIAL EXAMPLE 3

The sound pressure level by each frequency was measured regarding Example 1 under a condition that the sound absorption structure of Example 1 was installed in an air duct with a fan in a house. As a result of this test. It is confirmed that Example 1 performed good in sound absorption performance as is generally the same as that in an acoustic vibration test.

TEST

Figure 13:
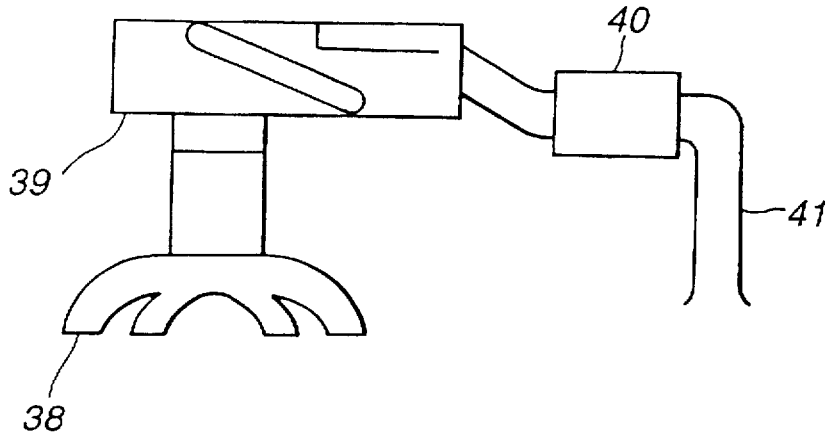
FIG. 13 is a view showing the sound absorption structural member installed to an intake system.

Each of Examples and Comparative Examples was practically installed to an air-cleaner duct of an intake system of a four-cylinder engine set in a semi-anechoic chamber as shown in FIG. 13, and each of them was tested to obtain an insert loss (IL) which is a difference between a sound pressure at an intake-manifold side and an air-inlet side of it. A reverse arrangement method was applied to this test. The reverse arrangement test was executed by applying a vibration generated at a speaker to the intake air side and measuring IL. The difference of the sound pressure levels was obtained by each frequency and represented dB unit. The measured results of each Examples and Comparative Examples were arranged into average data of a low frequency range smaller than 300 Hz, an intermediate frequency range 300 to 1000 (1K) Hz, and a high frequency range greater than 1 kHz. Such arranged data with each specification of Examples and Comparative Examples was shown in Table 1 and Table 2.

In TABLES 1 and 2, (Ex.No.) denotes Example No., (Comp.Ex.No.) denotes Comparative Example No., (Ext.ratio of Ext.D) denotes Extension ratio of Extended duct portion, (Leng.) denotes Length of structure, (Surf.den.Total wg.) denotes surface density and total weight, (Res.Freq.) denotes resonance frequency, (por) denotes portion, (N.area) denotes cross-sectional area of the neck portion, (Type of Struc.) denotes type of structure, (Ex.ratio) denotes structure extension ratio, (Stru.Leng.) denotes structure length, (Low F.) denotes low frequency range, (Med.F.) denotes medium frequency range, and (High F.) denotes high frequency range.

TABLE 1

| | Ext. ratio of Ext. D | Leng. (cm) | Sound absorption material | Denisity Total wg. | Other factor | Res. Freq. Of Resonator |
|---|---|---|---|---|---|---|
| Ex. No. | | | | | | |
| 1 | 1.5 | 20 | PP(3–5 μm) | 800, 20 | Inner pipe | 150 |
| 2 | 1.5 | 20 | PP(3–5 μm) | 800, 20 | Inner pipe | 150 |
| 3 | 1.5 | 20 | PP(3–5 μm) | 800, 20 | Inner pipe | 150 |
| 4 | 1.5 | 20 | PP(3–5 μm) | 800, 20 | Inner pipe | 150, 150 |
| 5 | 1.5 | 20 | PP(3–5 μm) | 800, 20 | Inner pipe | 130, 150 |
| 6 | 1.5 | 20 | PP(3–5 μm) | 800, 20 | Inner pipe | 150, 350 |
| 7 | 1.5 | 20 | PP(3–5 μm) | 800, 20 | Inner pipe | 150 |
| 8 | 1.5 | 20 | PP(3–5 μm) | 800, 20 | Inner pipe | 150, 350 |
| 9 | 1.5 | 20 | PP(3–5 μm) | 800, 20 | Inner pipe | 150, 350 |
| 10 | 1.5 | 20 | PP(3–5 μm) | 800, 20 | Inner pipe | 150, 350 |
| 11 | 1.5 | 20 | PP(3–5 μm) | 800, 20 | Inner pipe | 150, 350 |
| 12 | 1.5 | 20 | PP(3–5 μm) | 800, 20 | Inner pipe | 130, 150, 350 |
| 13 | 2 | 20 | PP(3–5 μm) | 800, 20 | Inner pipe | 150 |
| 14 | 1.5 | 20 | PP(3–5 μm) | 800, 20 | Inner pipe | 150 |
| 15 | 1.5 | 20 | PP(3–5 μm) | 800, 20 | Inner pipe | 150 |
| 16 | 1.5 | 90 | PP(3–5 μm) | 800, 20 | Inner pipe | 150 |
| 17 | 1.5 | 2 | PP(3–5 μm) | 800, 20 | Inner pipe | 150 |
| 18 | 1.5 | 20 | PP(3–5 μm) | 800, 20 | Inner pipe | 150 |
| 19 | 1.5 | 20 | PP(3–5 μm) | 800, 20 | Inner pipe | 150 |
| 20 | 1.5 | 20 | PET(ab.20 μm) | 1000, 20 | Inner pipe | 150 |
| 21 | 1.5 | 20 | PET(ab.20 μm) | 2000, 20 | Inner pipe | 150 |
| 22 | 1.5 | 20 | PET(ab.40 μm) | 1000, 20 | Inner pipe | 150 |
| 23 | 1.5 | 20 | PP(about 3 μm) | 600, 10 | Inner pipe | 150 |
| 24 | 1.5 | 20 | PP + PET | 1000, 20 | Inner pipe | 150 |
| 25 | 1.5 | 20 | PET(about 20 μm) | 800, 50 | Skin cover + no innet | 150 |
| 26 | 1.5 | 20 | PP(3–5 μm) | 800, 20 | No inner + 80% inner | 150 |
| Comp. Ex.No. | | | | | | |
| 1 | 1.5 | 20 | PP(3–5 μm) | 800, 20 | Inner pipe | 150 |
| 3 | 1.05 | 20 | PP(3–5 μm) | 800, 20 | Inner pipe | 150 |
| 6 | 1.5 | 3 | PP(3–5 μm) | 800, 20 | Inner pipe | 150 |
| 9 | 1.5 | 20 | PET(about 65 μm) | 800, 20 | Inner pipe | 150 |
| 10 | 1.5 | 20 | PP(3–5 μm) | 30, 20 | Inner pipe | 150 |
| 11 | 1.5 | 20 | PP(3–5 μm) | 5000, 20 | Inner pipe | 150 |
| 12 | 1.5 | 20 | PP(3–5 μm) | 800, 20 | 20% inner | 150 |
| 14 | 1.5 | 20 | PP(3–5 μm) | 800, 20 | 250 g/m$^2$ Sk. | 150 |

TABLE 2

| | Type of neck por. | N. area (cm$^2$) | Type of Struc. | Ex. ratio | Stru. Leng. | Low F. (dB) | Med. F. (dB) | High F. (dB) |
|---|---|---|---|---|---|---|---|---|
| Ex. No. | | | | | | | | |
| 1 | Insert | 9 | A | 2 | 20 | 11.2 | 12.5 | 20.2 |
| 2 | One hole | 9 | B | 2 | 20 | 10.2 | 12.8 | 20.3 |
| 3 | Slit | 9 | B | 2 | 20 | 10.1 | 13 | 20.5 |
| 4 | Insert | 9, 9 | C | 2 | 20 | 12.3 | 11 | 20.4 |
| 5 | Insert | 9, 9 | D | 2 | 20 | 14 | 11 | 20.3 |
| 6 | Insert | 9, 9 | E | 2 | 20 | 10.5 | 15.3 | 20.5 |
| 7 | Gen. | 9 | F | 2 | 20 | 11 | 13 | 21 |
| 8 | Gen. | 9, 9 | G | 2 | 20 | 11.2 | 15.4 | 20.9 |
| 9 | Gen. | 9, 9 | H | 2 | 20 | 11.3 | 18.4 | 20.1 |
| 10 | Insert | 9, 9 | I | 2 | 20 | 10.8 | 15.2 | 20.5 |
| 11 | Insert | 9, 9, 9 | J | 2 | 20 | 10.5 | 15 | 21 |
| 12 | Insert | 9 | K | 2 | 20 | 14 | 14.1 | 20.1 |
| 13 | Insert | 9 | A | 5 | 20 | 18 | 13.5 | 27.5 |
| 14 | Insert | 9 | A | 4 | 20 | 17 | 14 | 25 |
| 15 | Insert | 9 | A | 1.5 | 20 | 13.1 | 14 | 20.1 |
| 16 | Insert | 9 | A | 2 | 90 | 15.1 | 17 | 26.1 |
| 17 | Insert | 9 | A | 2 | 5 | 10.1 | 10.2 | 15 |
| 18 | Insert | 9 | A | 2 | 20 | 13.2 | 11 | 20.8 |
| 19 | Insert | 290 | A | 2 | 20 | 10 | 18.1 | 23 |
| 20 | Insert | 9 | A | 2 | 20 | 10.2 | 11.2 | 18 |
| 21 | Insert | 9 | A | 2 | 20 | 10.4 | 11.5 | 19.1 |
| 22 | Insert | 9 | A | 2 | 20 | 10.5 | 12.1 | 17.1 |

TABLE 2-continued

| | Type of neck por. | N. area ($cm^2$) | Type of Struc. | Ex. ratio | Stru. Leng. | Low F. (dB) | Med. F. (dB) | High F. (dB) |
|---|---|---|---|---|---|---|---|---|
| 23 | Insert | 9 | A | 2 | 0 | 11 | 13.1 | 19.2 |
| 24 | Insert | 9 | A | 2 | 20 | 10.3 | 11 | 20.1 |
| 25 | Insert | 9 | A | 2 | 20 | 11.3 | 12.3 | 20.8 |
| 26 | Insert | 9 | A | 2 | 20 | 11.2 | 12.6 | 21.2 |
| Comp. Ex.No. | | | | | | | | |
| 1 | Insert | 2.3 | A | 2 | 20 | 5.1 | 10.2 | 15.2 |
| 3 | Insert | 9 | A | 2 | 20 | 7.2 | 5 | 15 |
| 6 | Insert | 9 | A | 2 | 3 | 5 | 4.1 | 10.2 |
| 9 | Insert | 9 | A | 2 | 20 | 8 | 8.2 | 10.3 |
| 10 | Insert | 9 | A | 2 | 20 | 8.3 | 7.3 | 14 |
| 11 | Insert | 9 | A | 2 | 20 | 9.3 | 8.5 | 5.2 |
| 12 | Insert | 9 | A | 2 | 20 | 7 | 7.5 | 6.2 |
| 14 | Insert | 9 | A | 2 | 20 | 6.5 | 8 | 6.2 |

What is claimed is:

1. A sound absorption structure comprising:

a base duct portion;

an extended duct portion having a diameter greater than that of said base duct portion, said extended duct portion being connected to said base duct portion;

a sound absorption material being located at an interior side of said extended duct portion, said sound absorption material comprising a fibrous aggregate having a density ranging from 50 to 4000 $g/m^2$ and including fibers having an average diameter ranging from 0.1 to 60 μm; and a Helmholtz resonator having a resonant frequency corresponding to a resonant frequency range generated by said extended duct portion, said Helmholtz resonator being integrally connected with said extended duct portion.

2. A sound absorption structure as claimed in claim 1, wherein said Helmholtz resonator includes a volumetric portion connected to said base duct portion by at least one neck portion, each said at least one neck portion being one of a single-hole type, a slit type and an insert type.

3. A sound absorption structure as claimed in claim 1, wherein a center axis of said base duct portion corresponds with a center axis of said extended duct portion.

4. A sound absorption structure as claimed in claim 2, wherein a cross-sectional area of the neck portion of said Helmholtz resonator ranges from 7 to 400 $cm^2$, and the neck portion extending partially into the volumetric portion.

5. A sound absorption structure as claimed in claim 2, wherein the volumetric portion is arranged to surround said extended duct portion.

6. A sound absorption structure as claimed in claim 4, wherein the inner diameter of said extended duct portion is 1.1 to 3 times the inner diameter of said base duct portion and a longitudinal dimension of the sound absorption structure ranging from 5 to 100 cm.

7. A sound absorption structure as claimed in claim 1, wherein said sound absorption material includes one of woven fabric and nonwoven fabric.

8. A sound absorption structure as claimed in claim 1, further comprising:

an inner pipe having an inner diameter that is generally the same as that of said base duct portion and having an opening ratio ranging from 30 to 90%, wherein said sound absorption material is disposed between said extended duct portion and said inner pipe.

9. A sound absorption structure as claimed in claim 1, wherein the sound absorption structure is disposed at one of an inlet side and an outlet side of an air cleaner installed in an intake system of an internal combustion engine unit for an automotive vehicle.

10. A sound absorption structure comprising:

a base duct portion;

an extended duct portion having a diameter greater than that of said base duct portion, said extended duct portion being connected to said base duct portion;

a sound absorption material being located at an interior side of said extended duct portion, said sound absorption material including at least one of polyester fiber having an average diameter ranging from 10 to 40 μm and polypropylene fiber having an average diameter ranging from 0.1 to 10 μm; and a Helmholtz resonator having a resonant frequency corresponding to a resonant frequency range generated by said extended duct portion, said Helmholtz resonator being integrally connected with said extended duct portion.

11. A sound absorption structure comprising:

a base duct portion;

an extended duct portion having a diameter greater than that of said base duct portion, said extended duct portion being connected to said base duct portion;

a sound absorption material being located at an interior side of said extended duct portion;

a nonwoven fabric for covering at least a portion of said sound absorption material, said nonwoven fabric comprised of synthetic fiber, said nonwoven fabric having a density ranging from 20 to 200 $g/m^2$, and said synthetic fiber having a fiber length longer than 10 cm and an average diameter ranging from 1 to 30 μm; and a Helmholtz resonator having a resonant frequency corresponding to a resonant frequency range generated by said extended duct portion, said Helmholtz resonator being integrally connected with said extended duct portion.

12. A sound absorption structure for an intake system of an automotive vehicle, said sound absorption structure comprising:

an inlet base duct portion for connection to a supply of fresh air;

an outlet base duct portion for connection to the intake system;

an extended duct portion connected between said inlet and outlet base duct portions and having an inner diameter greater than that of said base duct portions;

an inner pipe portion coaxially disposed with respect to said extended duct portion and integrally connecting said inlet and outlet base duct portions, said inner pipe portion having a plurality of openings;

a sound absorption material disposed between said extended duct portion and said inner pipe portion; and a Helmholtz resonator having a resonant frequency corresponding to a resonant frequency range generated by said extended duct portion, said Helmholtz resonator including a volumetric portion surrounding said extended duct portion and a neck portion connecting said base duct portion to said volumetric portion.

* * * * *